US006000683A

United States Patent [19]

Van Allen

[11] Patent Number: 6,000,683

[45] Date of Patent: Dec. 14, 1999

[54] CARBURETOR THROTTLE AND CHOKE CONTROL MECHANISM

[75] Inventor: James E. Van Allen, Clifford, Mich.

[73] Assignee: Walbro Corporation, Cass City, Mich.

[21] Appl. No.: 08/979,581

[22] Filed: Nov. 26, 1997

[51] Int. Cl.[6] ..... F02M 1/02

[52] U.S. Cl. ..... 261/52; 123/179.18; 261/64.6

[58] Field of Search ..... 261/52, 64.6; 123/179.18, 123/339.25, 185.14, 185.1

[56] References Cited

U.S. PATENT DOCUMENTS

| | | | |
|---|---|---|---|
| 2,160,411 | 5/1939 | Blattner et al. | 261/52 |
| 4,123,480 | 10/1978 | Johansson | 261/52 |
| 4,167,929 | 9/1979 | Du Bois | 123/185.1 |
| 4,176,648 | 12/1979 | Gotoh et al. | 123/185.14 |
| 4,230,084 | 10/1980 | Gotoh et al. | 123/185.14 |
| 4,368,704 | 1/1983 | Masaki | 123/339.25 X |
| 5,069,180 | 12/1991 | Schmidt et al. | 123/179.18 X |
| 5,200,118 | 4/1993 | Hermle | 261/64.6 |
| 5,500,159 | 3/1996 | Martinsson | 261/52 |
| 5,611,312 | 3/1997 | Swanson et al. | 123/436 |

*Primary Examiner*—Richard L. Chiesa
*Attorney, Agent, or Firm*—Reising, Ethington, Barnes, Kisselle, Learman & McCulloch, P.C.

[57] ABSTRACT

A control mechanism for a carburetor having a throttle valve and a choke valve each having at least a cold-starting position and a full-speed position. The throttle valve is spring biased toward its third, low idle position, and the choke valve is spring biased toward its full-speed open position. When the choke valve is moved from its open position toward its cold start closed position a fast idle lever associated with the choke valve engages, via releasable latch parts, another lever associated with the throttle valve. The interengaging latch parts of these levers hold both valves in their respective cold-starting positions in opposition to the biasing springs. These latch levers can be released by operator actuation of the throttle valve control, thereby causing the choke valve to be automatically returned to its open position by its biasing spring, or, alternatively, the choke valve can be moved independently to its full-speed position. One of these latch levers has a row of fine ratchet teeth, and the other has a pawl selectively engaging whichever ratchet tooth becomes aligned therewith when the latch levers are operator actuated to their respective cold start positions. Upon release of operator actuating force, this feature prevents most, if not all of the retrograde movement of the choke and throttle valves out of their design cold start positions, despite operating slack in the latch system due to manufacturing tolerance stack-up in the various parts of the control mechanism in their assembly and operation.

11 Claims, 4 Drawing Sheets

CARBURETOR THROTTLE AND CHOKE CONTROL MECHANISM

FIELD OF INVENTION

The present invention relates to throttle and choke control mechanisms of carburetors for internal combustion engines, and more particularly to such a mechanism incorporating a choke-throttle cold-start-setting latch mechanism that automatically positions the throttle valve slightly open when the choke valve is fully closed.

BACKGROUND OF THE INVENTION

In small carburetors designed for use with low displacement gasoline fueled engines, such as used on chain saws, weed whips, lawn mowers, garden tractors and other small lawn, garden, and forestry portable appliances, manually operated choke and throttle controls are typical provided and often hand cranking is employed for starting the engine. Prior to the late 1970s, chain saws equipped with such choke and throttle controls often involved a basic starting sequence which left much to be desired. First the choke valve was fully closed to its start position, and then the starter rope was pulled until the engine fired. The closed choke valve usually caused the engine to immediately die at this first firing due to over-enrichment of the air fuel (A/F) mixture. This is commonly referred to as a false start. At this point the choke valve had to be opened. Then the starter rope was pulled again until the engine finally began running.

This starting sequence was subsequently improved by adding another start-up control to the chain saw whereby the throttle valve could be held at a partly opened position, known as fast idle position. This generally avoided false starts due to the increased air flow permitted past the throttle valve.

In order to avoid the need for three separate manually operated controls, namely, a throttle control, a choke control and fast idle start control, Johansson U.S. Pat. No. 4,123,480, issued Oct. 31, 1978 (which is incorporated herein by reference), disclosed an improved chain saw engine control mechanism. The automatic fast idle setting mechanism of the Johansson U.S. Pat. No. 4,123,480 is shown herein in FIGS. 1, 2 and 3 which correspond respectively to FIGS. 1, 3 and 4 of the '480 patent. The direction of air-flow through the carburetor throat is indicated by the arrow labeled "A" in these views, as well as in all other views in the drawings herein. For convenience, the reference numerals employed in FIGS. 1, 2 and 3 are those employed in '480 patent, to which further reference may be made for the details of the construction and operation of the same.

In the '480 patent a fast idle secondary lever 9 is pivoted on the choke valve shaft 11 and is operable to engage a tang of a latch arm of a throttle lever 4 fixed on the throttle valve shaft 2 to cause the throttle valve 1 to open to a predetermined angle corresponding to the fast idle position (FIG. 2). With this arrangement, the operator need only operate a single start-up control, namely the choke valve control (not shown) coupled to the choke shaft control lever 12 in order to set the throttle 1 in fast idle condition. Thus when the operator moves the choke control to swing the choke valve 10, via lever 12 from fully open position (FIG. 1) to its fully closed start position (FIG. 2), the pivotal motion of choke shaft control lever 12, via a coupling tang 14 on the adjacent fast idle lever 9, pivots fast idle lever 9 and causes its notch 8 to latch engage and hold the throttle lever latch arm tang 7, thereby automatically setting the fast idle latch mechanism. The bias of the respective choke and throttle shaft return springs 15 and 3 also provide the yieldable latch closing forces.

Then, if the chain saw engine experiences a false start, the choke lever 12 may be moved to the open position (FIG. 3) without thereby moving the fast idle lever 9 so that it remains engaged with the throttle lever 4 to retain the throttle valve 1 in the fast idle position. Once the chain saw engine starts, the operator simply depresses the throttle control trigger 6 to open the throttle valve 1. This pivots the throttle shaft lever 4, thereby causing it to disengage the fast idle lever 9 and thus cause release of the latch. If the choke valve 10 was still in the closed position at this point, the choke biasing spring 15, acting through the fast idle lever 9 and tang 14 coupling it to the choke lever, would automatically cause the choke valve 10 to be returned to full open position upon such unlatching of the fast idle lever 9 from the throttle lever 4 (FIG. 1).

One of the disadvantages of this '480 patent design is its failure in practice when mass produced to insure complete and/or consistent closure of the choke valve 10 when setting the fast idle latch starting system. The specific problem has been found to be due to the choke valve sometimes not completely closing even though the operator has fully engaged the choke control to indicated start position. Further, it has been found that this problem is due to a stack up of normal manufacturing tolerances in the parts as manufactured for assembly into the fast idle latch mechanism.

Such manufacturing tolerances are, of course, necessary to set up minimum dimensional range limits or allowances to accommodate normal manufacturing equipment capabilities at acceptable manufacturing cost levels. This is a particular problem in producing carburetors for engines for chain saws, lawn mowers, clearing saws, weed whips, etc. that require very low manufacturing cost due to the low retail price of such consumer products. The problem is compounded due to the small size of the carburetors for such small engines, and the corresponding minuscule size of the choke and throttle parts involved in the carburetor mechanisms. These factors make it particularly difficult to reduce manufacturing tolerance allowances in order to reduce the adverse effects of unavoidable manufacturing dimensional variations in such tiny parts when assembled for operation in the mechanism.

Thus, in the case of the incomplete and/or inconsistent closure of the choke valve in the operation of the fast idle starting system of the '480 patent arrangement, it has been found that a shift in tolerances for all parts (tolerance stack-up) in the latch mechanism to one end limit will render the choke valve incapable of reaching the fully closed position. This prevents, or at least hinders engine starting. On the other hand, a tolerance shift in all of these parts to the opposite end limit will cause the fast idle lever to fail to even engage with the throttle lever, so that no "latch up" action occurs. This results in a loss of function of the entire choke throttle fast idle system.

The culprit in this problem has been found to be the push coupling via tang 14 between the choke lever 12 and fast idle lever 9. This dictates that the actual position of choke valve 10 when swung toward closed position will be controlled by the latched up position of fast idle lever 9 when the engaged throttle lever latch tang 7 and idle lever notch 8 of the latch system (if indeed engaged) swing slightly back to their spring held, stable, latched position after manipulating forces are removed from the manual controls of the appliance, as will be explained and seen in more detail hereinafter in conjunction with FIGS. 8–13. It is also noted that the '480 patent states (but does not illustrate or explain) at column 4, line 60–65 that it is possible to arrange the '480 mechanism in such a way that it can arrest the throttle valve and the choke valve in several different combinations of positions by designing the fast idle lever and/or the throttle lever with several recesses and projections respectively. Although this general statement is obviously ambiguous and unclear, this variation may be intended for the purpose of somehow providing sequential engine operational stages such as part-open choke valve positions often used for certain appliance applications, or for engines for which such adaptations may be suitable or desirable to satisfy differing engine operational mode requirements to suit the load and conditions of use of the appliance.

Another prior art solution to the problem of achieving automatic fast idle setting of the throttle valve is found in Hermle U.S. Pat. No. 5,200,118, issued Apr. 6, 1993 and assigned to Walbro Corporation of Cass City, Mich., assignee of record herein. A fast idle throttle latch system with automatic release in accordance with the '118 patent is shown in FIGS. 4, 5, 6, 7A and 7B in the drawings herein, which correspond respectively to FIGS. 5,3,2,1, and 4 of the '118 patent. Again, for convenience the reference numerals employed in FIGS. 4–7B herein are those appearing in such drawing figures of the '118 patent, to which reference may be had for further details of construction and operation (U.S. Pat. No. 5,200,118 also being incorporated herein by reference).

It will be seen from FIGS. 4–7B herein, and by reference to the specification and claims of the '118 patent, that the choke valve 10 is "divorced" as to its operator control handle 16 and associated linkage from the control handle 28 and associated linkage for the fast idle lever 20, which is thus independently operated through its own crank arm 24 of its bell crank 20. The '118 system thus provides a separate manual control 16 to operate the choke valve 10, and likewise the fast idle latch lever 20 is operated solely by actuating its own control member 28. For convenience to the operator, these two separate actuating members 16 and 28 are associated in their physical location so that they can be easily conjointly manipulated ganged as one unit, if desired, or individually and separately manipulated, as will be seen in FIGS. 4 and 7A.

It will be seen that with the '118 patent system there is no tang coupling between choke lever arm 12 and the fast idle latch bell crank 20 and hence the '118 patent system does not present the aforementioned incomplete choke closure problem of the '480 patent system. This is because the latched-up position of bell crank 20 does not affect or in any way hinder complete closure of choke valve 10, when it is individually manipulated to this condition by its own actuating control 16. Likewise setting bell crank 20 with handle 28 in order to latch up with throttle lever 8 in no way affects choke valve 10. Nevertheless, as in the '480 patent system, when the chain saw engine has been started, and then the throttle trigger depressed, the fast idle lever will be automatically disengaged to allow spring return to its at rest position as shown in FIGS. 4 and 7B.

It should be noted that at some point in time subsequent to the issuance of the '118 patent, a running change was made in the production of carburetors embodying a '118 patent control mechanism. In order to enable setting of the fast idle bell crank latch 20 with the actuating handle 28 adjustably set in a range of "latch-up" positions, several relatively large notches were provided on the free end edge of bell crank arm 22 in place of the single notch 21 referenced in FIG. 4. These notches were designed to be individually engaged by free end edge 23 of throttle lever 8 to set the throttle valve 6 in the fast idle position of FIGS. 5 and 6 regardless of in which of these inner end limit positions the actuating handle 28 was set.

Nevertheless, the aforementioned prior art neither addresses the problems nor provides a solution thereto that insures that, in the case of the '480 fast idle mechanism, as manufactured in mass production practice, the choke will be able to reach the fully closed position at fast idle latch-up. Therefore, the problems of poor starting, or in worst case, "no starting", have continued to prevail for many years despite the wide spread use of the '480 system on carburetors supplied by several major carburetor manufacturers utilizing the '480 system.

These problems resulting from incomplete and/or inconsistent closure of the choke valve in the fast idle starting system of the '480 patent will be better understood by referring to layouts of the choke valve and throttle valve and actuator levers as set forth in FIGS. 8–13 herein.

FIGS. 8, 9 and 10 are vertically arrayed in alignment and illustrate a layout developed in pursuing the invention herein to better analyze the foregoing problems involved in the construction and operation of a commercial embodiment of the '480 fast idle system, wherein parts alike to those in the '480 patent are given like reference numerals. This system layout thus shows throttle valve plate 1, throttle lever 4, fast idle lever 9, choke valve plate 10 and choke lever 12. Throttle plate 1 and throttle lever 4 are mounted on throttle shaft 2 for rotation therewith, and choke lever 12 is mounted on and keyed for rotation with choke shaft 11 for rotating choke plate 10. Fast idle lever 9 is journalled on choke shaft 11 for free rotation relative thereto. Dimensions B, C and D respectively define the width of the carburetor casting body, the center-to-center distance between shafts 2 and 11 and the distance of the center of shaft 2 from the outlet face of the carburetor body.

Dimension E (FIGS. 9 and 12) represents the gap between the free end edge of tang 7 of throttle lever 4 as spaced from surface 8*a* of notch 8 of fast idle lever 9, with tang 7 resting on face 8*b* of notch 8 when choke shaft 11 has been rotated by choke lever 12 to the full closed choke position shown in FIG. 9 by manual force operator-applied to the choke operating cable (not shown). FIG. 10 illustrates the position of the parts when operator actuating force is released from choke lever 12 and the parts are allowed to "back up" (retrograde rotation) and thereby assume their fully latched engaged position as held solely by the biasing forces of their respective return springs.

It is to be noted that FIGS. 8, 9 and 10 represent the operation of the parts when manufactured to "nominal" design dimensional specifications, i.e., using the mean dimensional valve of each present production part as presently print specified using the tolerance variation presently allowed in the parts, and thus represents an idealized condition for current production. It will thus be seen that fast idle arm 9 is swung from its rest position in FIG. 8 by control linkage pulling on choke lever 12 to rotate the same counter-clockwise as viewed in FIGS. 8–10. Choke lever 12,, through its engagement with tang 14 of the fast idle lever 9, thus swings lever 9 from the FIG. 8 position counter-clockwise so that the lever free end leading edge 9*a*, in advance of notch 8, first engages tang 7 of throttle lever 4 prior to notch 8 reaching the FIG. 9 position wherein tang 7, acting as a detent, has sprung into notch 8. Lever 9 continues this counter-clockwise swing through the FIG. 10 position, wherein tang 7 is still detent engaged in notch 8 and is now abutting notch surface 8*a*, and then completes its operator-driven swing when the parts reach the position of FIG. 9, wherein the corresponding swing of choke valve plate 10 is positively stopped by the protruding portion of its peripheral edge striking the carburetor throat bore surface.

Note that the design layout of FIG. 9 calls for the choke plate 10 being positively stopped in fully closed position at an angle of 15° from a design plane PC that intersects perpendicularly the throat axis X of the carburetor. This interengaged latching position will be achieved by operator manual force applied to the control cable attached to choke lever 12 working against the bias of the return spring (not shown) acting on lever 9, and against the bias of the return spring (not shown) acting on throttle lever 4.

However, note that when the operator releases his control manipulating force, the return springs will retrograde pivot levers 9 and 4 from the FIG. 9 position back to the FIG. 10 position. The FIG. 10 position thus represents the nominal (idealized) fully latched-up condition with the throttle valve plate 1 is solely spring held in fast idle position and the choke valve plate 10 is solely spring-held in nominal fully closed position by the fast idle latch system. It will be seen that the dimension of gap E enables 3° of retrograde pivotal motion of the latch parts from the FIG. 9 to the FIG. 10 position, thereby allowing the return springs to move the throttle valve plate 1 from an inclination of 31° (FIG. 10) to an inclination of 28° relative to a design plane PT coincident with the axis of shaft 2 and perpendicularly intersecting the carburetor throat axis X. More significantly, choke valve plate 10 will swing back open through an angle of 3° from the 15° position shown in FIG. 9 to the 18° inclination position of FIG. 10. However, this FIG. 10 very slightly open position of choke valve plate 10 nevertheless has hitherto been accepted as functionally fully closed for achieving existing carburetor design optimum performance.

FIGS. 11, 12 and 13 are layouts corresponding to FIGS. 8, 9 and 10 respectively and in which the moving parts of the fast idle latch system are laid out on the same scale as FIGS. 8, 9 and 10, but are all theoretically made to one limit of their dimensional tolerances to represent one extreme of the design tolerance stack-up. It will be seen that dimension E in FIG. 12 is substantially greater than the corresponding dimension E in FIG. 9. It will also be seen that the fast idle lever 9 engages tang 7 earlier in its path of swing travel during choke closure, as illustrated by the relative angulation of the parts in FIG. 13 as compared to FIG. 10. Lever 9 finally reaches the stop limit position of FIG. 12 when choke plate 10 is forced against the surface of the carburetor bore in its actual fully closed position, and hence is again inclined at an angle of 75° from the carburetor throat axis X. Then when operator manual force is released from the control actuating member, the biasing forces of the return springs acting on levers 4 and 9 pivot the same back from the position of FIG. 12 to the fully engaged, solely-latch-held position of FIG. 13.

It will be seen that the tolerance stack-up gap E of FIG. 12 thus now enables choke plate 10 to pivot out to a position inclined at 25° from plane PC, which is a full 10° farther open from fully closed position of FIG. 12. Likewise, throttle plate 1 now has pivoted to a fast idle position inclined at 26° from plane PT, which is 2° more closed than the corresponding nominal 28° design position of FIG. 10. Thus allowing choke valve 10 to remain partly so opened, and throttle plate 1 more closed than desired, in their respective latched-up condition causes some level of performance degradation, ranging from starting difficulty to failure to start. Accordingly, inadequate starting A/F enrichment functioning of such valve plates thus plates results when the parts are made to the tolerance stack-up of FIGS. 11–13.

On the other hand, at the other extreme of design tolerance stack-up (not illustrated), the choke valve plate 10 will reach the fully closed stopped position (75° of rotation from fully open) before tang 7 of throttle lever 4 has even engaged any free end edge surfaces of fast idle lever 9. Hence, at this other tolerance limit the result is a complete failure of the fast idle system to function.

By way of example and not by way of limitation, the dimensional values employed for the foregoing analysis illustrated in FIG. 8–13 were as follows(wherein the parts are shown to engineering scale and, for example, dimension B is 33.66 mm in the nominal case):

| | DIMENSIONAL VALUE | |
|---|---|---|
| NAME OF PART | Nominal | Worst Case |
| Width of casting dimension B | 33.66 mm | 33.28 mm |
| Center-to-Center distance between shafts 2 and 11 | 24.00 mm | 24.12 mm |
| Dimension D | 6.35 | 6.47 |
| Choke Lever 12 | 2.50 | 2.62 |
| Fast Idle Lever 9 | 3.8 | 3.6 |
| | 17.55 | 17.45 |
| | 55° | 56° |
| Throttle Lever 4 | R 8.0 | 7.8 |
| | 13.00 | 12.83 |
| Choke Shaft 11 | 4.72 | 4.69 |
| | 2.06 | 2.11 |
| Choke Shaft Assembly | 55° | 58° |

OBJECTS OF THE INVENTION

Accordingly, among the objects of the invention are to provide an improved carburetor choke and throttle mechanism providing automatic throttle fast idle setting capability that obtains the advantages of the Johansson U.S. Pat. No. 4,123,480 system as compared to the alternative system of the Hermle U.S. Pat. No. 5,200,118, while at the same time overcoming the aforementioned problems encountered in mass production of carburetors employing the '480 patent system so that when the parts are made to the existing entire range of dimensional tolerances the fast idle lever will nevertheless properly engage the throttle lever in such a manner that the choke valve plate will move to, and remain in, the fully closed position, thereby eliminating the poor starting or worse case, no starting, conditions described herein above.

Another object of the invention is to provide an improved carburetor choke and throttle automatic fast idle mechanism of the above character which solves the aforementioned problems by replacing only one part, namely a corresponding but improved fast idle lever part, at little or no additional cost and one that can be substituted as a running change in production, that does not significantly alter the manufacturing and assembly processes already employed in the manufacture of the prior mechanism, which is readily retrofitable to existing carburetors as a field repair item if desired, and which does not require any tightening up of existing manufacturing tolerances and thus avoids the additional costs of attempting to achieve such improved precision in processing methods and machinery as well as assembly equipment and fixturing.

SUMMARY OF THE INVENTION

In general, and by way of summary description and not by way of limitation, the invention fulfills the foregoing objects by merely substituting only a novel fast idle lever part for the prior art fast idle lever part, the remaining parts of the carburetor automatic fast idle control mechanism being retained and utilized without change.. The free end catch surface of this fast idle lever now features a row of fine teeth to provide serrations that function as a precision ratchet when engaged by the existing throttle lever tang edge that in turn now functions as a cooperative pawl in the fast idle latch system. Hence, a one-way precision clutch action is achieved that prevents or at least greatly minimizes adverse retrograde opening motion of the choke valve from its fully closed design position upon release of operator actuating force.. This is achieved regardless of variations in the angular range of relative orientation of the fast idle lever free end with respect to the tang of the throttle lever throughout the range of tolerance stack-up positions of these as well as the remaining operably cooperative mechanism parts when mass produced to the pre-existing tolerance specifications.

As another feature, the circumferential extent of the row of ratchet tooth serrations on the fast idle lever is made large enough to insure pawl engagement within the angular range of swing tolerance limits of the choke lever and associated fast idle lever as oriented at the choke closed condition. In addition, the row of ratchet teeth of the fast idle lever has an enlarged width dimension so that pre-existing lateral misalignment tolerances between the choke lever tang pawl and the free end edge of the fast idle lever are also accommodated by the extra-wide row of ratchet teeth. Preferably the improved fast idle lever is mass produced as a low cost yet precision injection molded part that as molded is in finished condition.

If desired, the disposition of the ratchet teeth and tang pawl on the cooperative fast idle and choke levers may be reversed. However, this would require making two new substitute parts instead of only one such part if done as a running change in production of existing carburetors utilizing prior art '480 patent type mechanical choke/throttle fast idle interlock mechanisms. Hence providing the invention features on only the fast idle lever part is preferred, both for manufacturing cost reduction reasons as well as simplifying field service and field retrofit to such prior carburetor mechanisms already in service in the field.

BRIEF DESCRIPTION OF THE DRAWINGS

The foregoing as well as other objects, features and advantages of the present invention will become apparent from the following detailed description of the best mode, appended claims and accompanying drawings (which are to engineering design scale unless otherwise indicated) in which:

DETAILED DESCRIPTION OF THE PREFERRED EMBODIMENTS OF THE INVENTION

Figure 1:
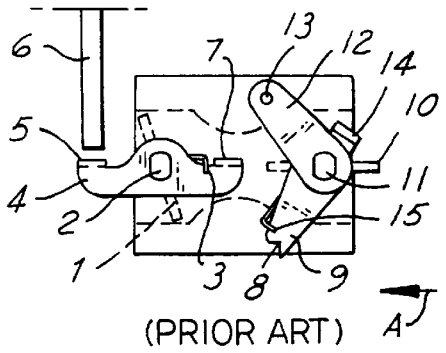
(PRIOR ART) FIG. 1
FIGS. 1–3 are views corresponding to FIGS. 1, 3 and 4 respectively of Johansson U.S. Pat. No. 4,123,480.
Figure 4:
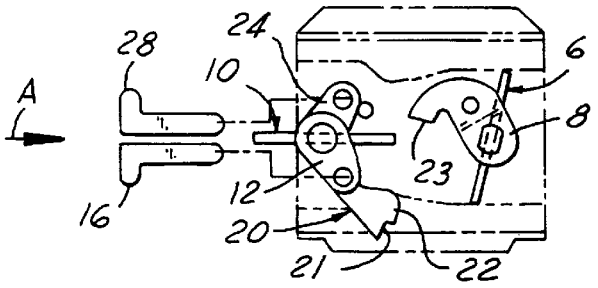
(PRIOR ART) FIG. 4
FIGS. 4, 5, 6, 7A and 7B are views corresponding to FIGS. 5, 3, 2, 1 and 4 of Hermle U.S. Pat. No. 5,200,118.
Figure 2:
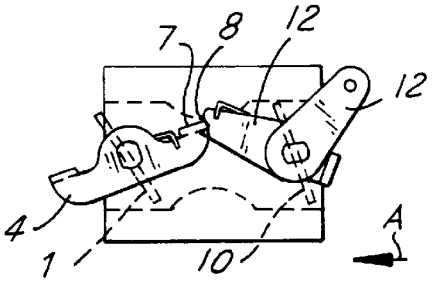
(PRIOR ART) FIG. 2
Figure 5:
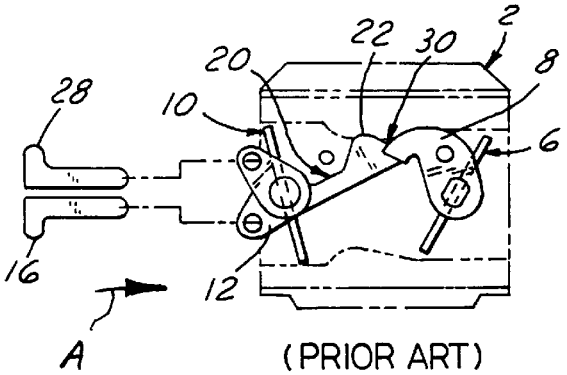
(PRIOR ART) FIG. 5
Figure 3:
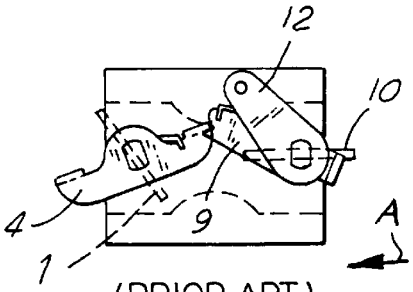
(PRIOR ART) FIG. 3
Figure 6:
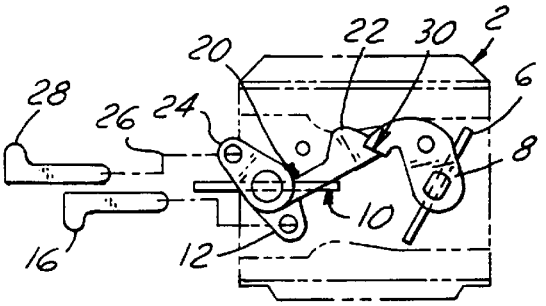
(PRIOR ART) FIG. 6
Figure 7A:
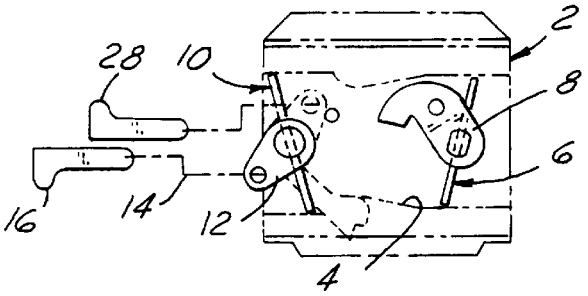
(PRIOR ART) FIG. 7A
Figure 10:
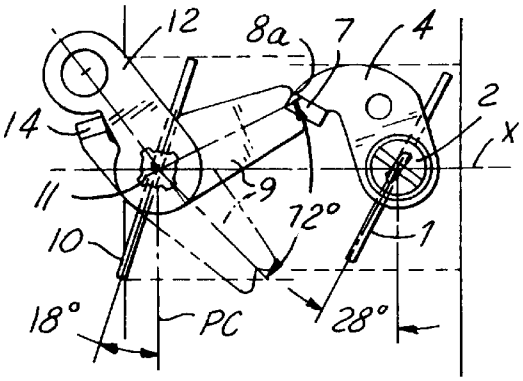
(PRIOR ART) FIG. 10
FIGS. 8–10 are sequential design layout views of commercial embodiment components employed in the system of FIGS. 1–3 as designed to a nominal mean of the existing production tolerances to illustrate the best presently achievable cooperation of these existing parts in assembly and operational positions.
Figure 11:
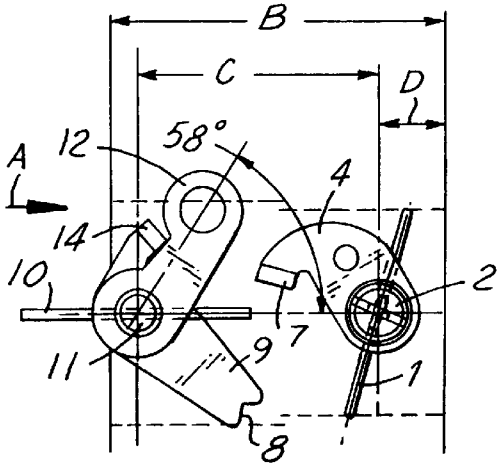
(PRIOR ART) FIG. 11
FIGS. 11, 12 and 13 correspond to FIGS. 8, 9 and 10 but illustrate the same parts when designed to one extreme of worst case present manufacturing tolerance limits to illustrate resultant incomplete closure of the choke valve when the parts are so manufactured.
Figure 8:
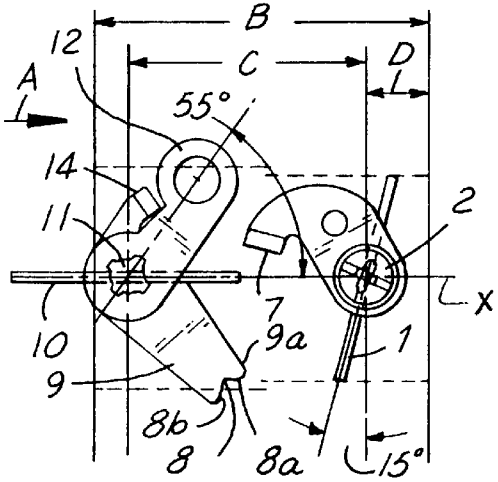
(PRIOR ART) FIG. 8
Figure 9:
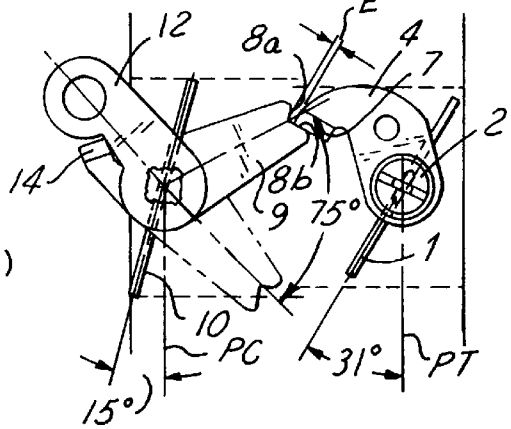
(PRIOR ART) FIG. 9
Figure 7B:
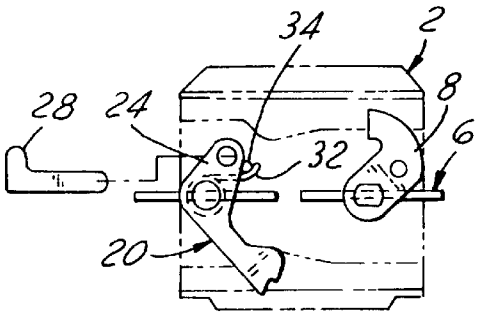
(PRIOR ART) FIG. 7B
Figure 12:
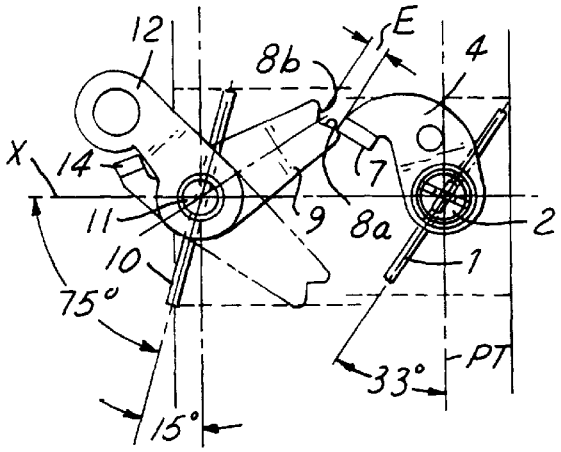
(PRIOR ART) FIG. 12
Figure 14:
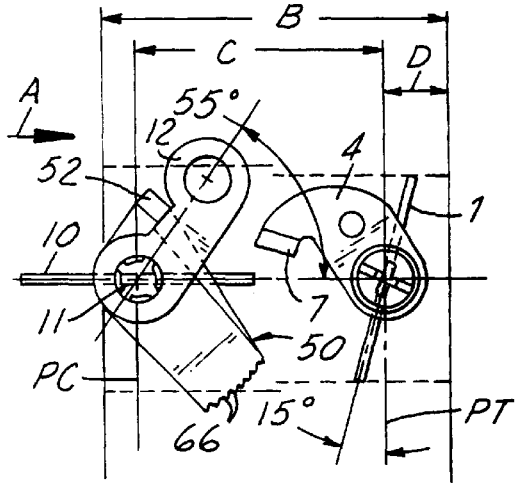
FIGS. 14 and 15 are design layout views (respectively corresponding to FIGS. 8 and 10) of the improved carburetor throttle and choke fast idle automatic latch mechanism of the invention respectively illustrating the fully opened and fully closed positions of the choke valve, and the fully closed (low speed) and fast idle positions of the throttle valve when manufactured to nominal (mean) design tolerances corresponding to those employed in the layout illustration of the prior commercial system in FIGS. 8–10.
Figure 13:
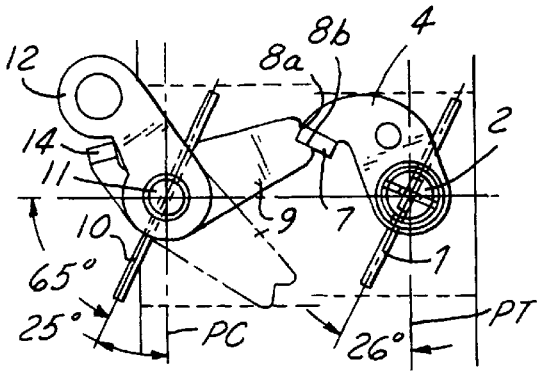
(PRIOR ART) FIG. 13

Referring in more detail to the accompanying drawings, FIGS. 14–17 illustrate the improved throttle-choke automatic fast idle throttle setting mechanism of the invention. Note that, except for the fast idle lever 9 of the prior art construction described previously in conjunction with FIGS. 1–3 and 8–13, the system of FIGS. 14–17 employs the same component parts and operates generally in the same, albeit improved, manner. Hence, like reference numerals are employed to identify like parts and their description not repeated with reference to FIGS. 14–17.

By comparing FIGS. 14–17 with FIGS. 8–13 it will be evident that the only change required to accomplish the objects of the invention is to provide a new fast idle lever 50 as a direct replacement substitute for fast idle lever 9 of the prior art system of FIGS. 8–13. Fast idle lever 50 is thus mounted on choke shaft 11 for free rotation thereon in the manner as lever 9, located adjacent choke lever 12, and has a laterally protruding tang 52 that in assembly overlaps and abuttingly engages the side of choke lever 12 in the same manner as tang 14 of lever 9. The overall length, thickness and width dimensions of part 50 are generally the same as part 9, and hence involve very little, if any change in manufacturing or assembly processes, fixtures, equipment and procedures when substituting new part 50 for old part 9 in production.

The structural details of improved fast idle lever 50 are shown to engineering scale in the engineering detail views of FIGS. 18–21. Preferably fast idle lever 50 is manufactured as an injection molded part from suitable high strength plastic material, such as that sold under the brand name "CELANEX 3300" plastic material, as a precision as-molded part on a mass production basis. Lever 50 has a mounting hole 54 corresponding to the like mounting hole in arm 9 for close slip-on rotary fit on choke shaft 11. The opposite sides 56 and 58 of lever 50 are flat, parallel with one another and are spaced apart to provide a thickness dimension corresponding to that of the prior lever 9 to facilitate retrofit substitution therefor. Likewise, the position and dimensions of tang 52 simulate those of tang 14 of prior lever arm 9.

The principal differences between levers 9 and 50 are seen in the configuration of the free end portion 60 of lever 50 and that of its top and bottom side edges 62 and 64. The free end edge 60 of lever 50 has a serrated ratchet face formed by a row of fine teeth 66, each having an apex 68 extending parallel to the rotational axis RX (FIG. 18) of lever 50 in assembly on shaft 11. In the preferred but exemplary embodiment of fast idle lever 50 shown to scale in FIG. 18–21, there are a total of seven ratchet notches defined by teeth 66, and the same are very closely spaced in the formation of the row of fine teeth 66 on the free end edge of fast idle lever 50.

Figure 21:
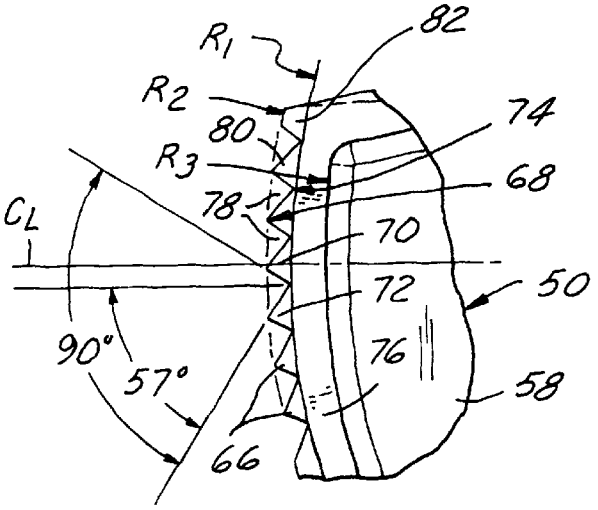
FIG. 21 is a fragmentary view of the portion of FIG. 20 encompassed by the circle 20 in FIG. 20 but greatly enlarged thereover to better illustrate ratchet tooth detail of the fast idle lever.

Referring to FIG. 21, the centrally located teeth 70 and 72 preferably define an included angle therebetween of 90°, and the tooth root therebetween is located on a radius line preferably spaced 2.34° below center line $C_L$. The angulation from this radius line to the adjacent face of tooth 72 preferably defines and including an included angle of 57°. To facilitate injection molding, this 57° angle preferably will change in increments of 4° as it moves around radius $R_1$, and preferably no accumulation of tolerances is to be permitted in its manufacture. The apex 68 and root 74 of each tooth preferably are to be made to sharp corners.

Figure 18:
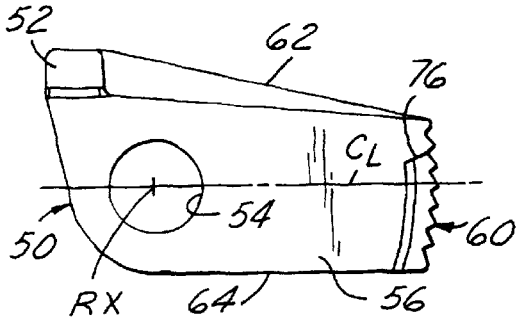
FIG. 18 is an elevational view of the improved fast idle lever of the invention shown by itself in side elevation.
Figure 19:
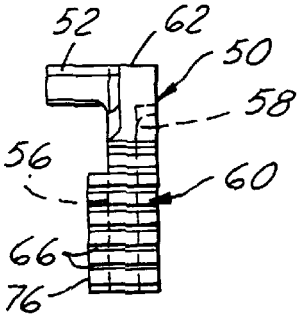
FIG. 19 is an end elevational view of the serrated toothed end of the fast idle lever of FIG. 18.
Figure 20:
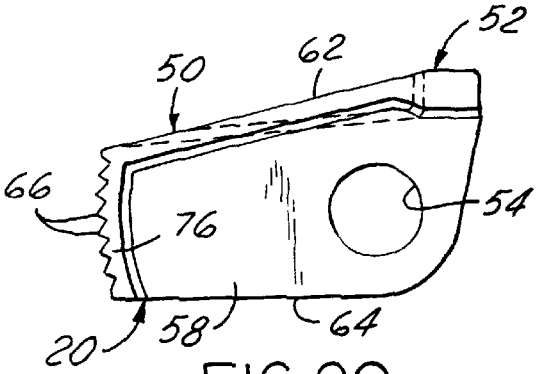
FIG. 20 is a side elevational view of the side of the fast idle lever opposite from that shown in FIG. 18.

As will be seen in comparing FIGS. 18 and 19, the free end edge of lever 50 has a lateral protrusion or sidewise extension 76 so that all but the top two teeth 80 and 82 (FIG. 21) in the row of teeth 66 have a lengthwise dimension (parallel to the plane of the drawing in FIG. 19) greater than (about 225%) the thickness dimension between the main sidewalls 56 and 58 of fast idle lever 50. The upper edge 62 also overhangs sidewall 58 to provide a strengthening rib that does not interfere with assembly fit of lever 50.

Figure 15:
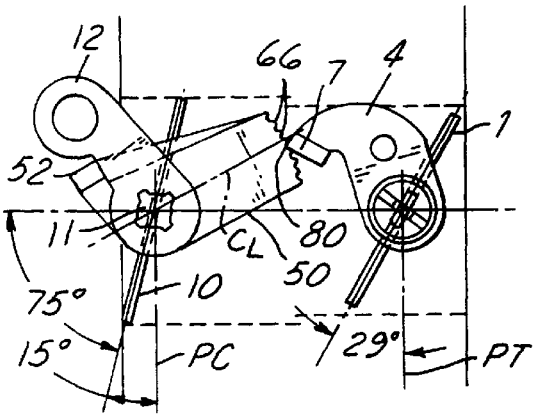
Figure 16:
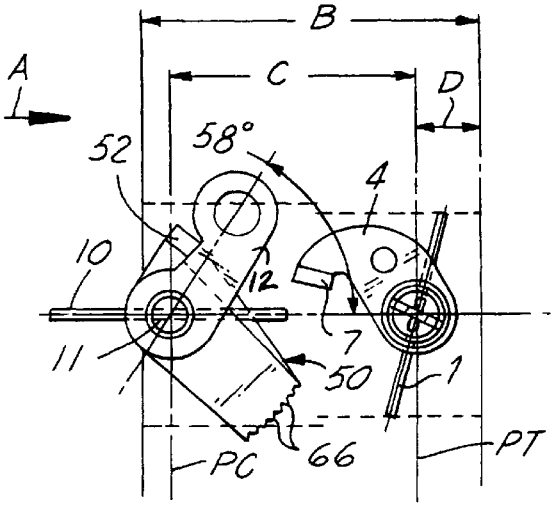
FIGS. 16 and 17 are similar plan layout views of the parts shown in FIGS. 14 and 15 but in positions as solely-latch-held when manufactured to one extreme limit of manufacturing tolerances to illustrate one worst case condition.

In assembly and operation of fast idle lever 50 it will be seen that this fine row of teeth 66 provide a successive series of ratchet catch notches 78 constructed and arranged at closely spaced angular increments, any one of which is capable of being individually ratchet-engaged by the free end edge 80 of tang 7 of throttle lever 4 to securely establish a locked-up latch condition of throttle lever 4 with fast idle lever 50. As will be seen FIG. 15, when the system parts are made to nominal mean existing tolerances outer corner edge 80 of tang 7 engages a tooth notch between teeth 70 and 72. Thus even when operator force is released, choke valve plate 10 and throttle valve plate 1 are thereby solely positioned angularly by the latch mechanism of the invention as shown in FIG. 15. Note that the holding angles of the valves as solely latch-held are now improved over that shown in FIG. 10.

Figure 17:
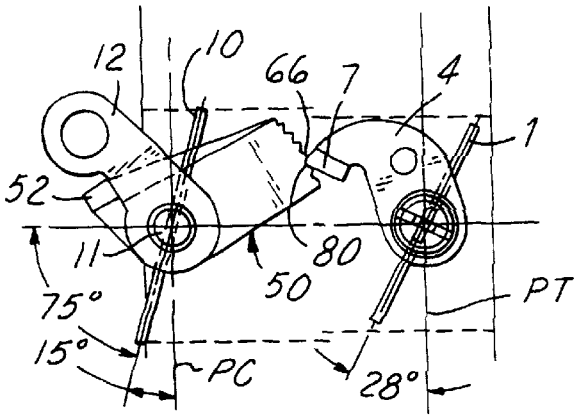

FIG. 17 shows the upward change in angulation of lever 50 under one worst case latch-up resulting from manufacturing of all of the parts at one extreme of the existing tolerance limits. The parts when so made thus have, in assembly, allowed tang edge 80 to slip or ratchet down one notch on the tooth face. In FIG. 17, like FIG. 15, the positions of lever 50 and throttle lever 4 are being maintained solely by the valve shaft return springs of the control mechanism with no operator force applied. As seen by comparing FIG. 17 to FIG. 15, under these conditions the angle of throttle plate 1 is thus only shifted from the inclination of 29° (from plane PT) shown in FIG. 15 to the inclination of 28° shown in FIG. 17, i.e., a mere 1° change in angulation. It thus will be evident from the above that the improved fast idle lever 50 of the invention achieves greatly improved and surprising results in assembly and operation over the prior control mechanisms discussed hereinabove.

In accordance with a principal feature of the invention, and because of the plurality of fine teeth 66 on the free end edge of fast idle lever 50, the same will ratchet lock up with tang 7 of throttle lever 4 at whatever tooth notch is presented to tang edge 80 when choke plate 10 is positively stopped in its fully closed position of FIGS. 15 and 17.

Moreover, this optimized latch-up occurs regardless of whether or not the parts are made to the minimum or maximum of the allowance limits of the tolerance range presently specified for the manufacture of parts of the throttle-choke fast idle latch mechanism because the overall circumferential extent of the row of teeth 66 is made to extend just beyond the two outer angular tolerance limits of travel of choke lever 12. Thus, the lowermost tooth notch will be caught by tang edge 80 in the case of a fully closed choke when the angle of choke lever 12 (measured from its center line to the plane of choke plate 10) is at the maximum of its tolerance limits. As shown by way of example in the drawings, this is an angle of 55° with a tolerance or plus or minus 2°. Conversely, the uppermost tooth is arrayed on the free end edge of lever 50 in a position to still catch tang pawl edge 80 in the condition of a fully closed choke when the angle of the choke lever is at the minimum of its tolerance specification of the angulation between choke lever 12 and choke plate 10.

Preferably, the return springs for biasing fast idle lever 50 and throttle lever 4 are those employed for return-biasing the choke and valve shafts, and are oriented and arranged to respectively exert a clockwise rotational moment on fast idle lever 50 and a counter-clockwise rotational moment on throttle lever 4, so that both valve return springs exert lock-up force on the system when automatically latched in fast idle condition. Thus, in the unlatched condition of the mechanism choke plate 10 is spring biased to its fully opened position of FIGS. 14 and 16, and throttle plate 1 is spring biased to its fully closed (low speed run) positions of FIGS. 14 and 16, thereby complying with conventional carburetor/engine operational safety standards.

From the foregoing description and drawings, it now will be apparent to those skilled in the art that the latch system of the invention amply fulfills the aforestated objects and provides many advantages over the prior art. The automatic latching system for positioning the throttle plate in fast idle position in accordance with the invention retains the advantages of a single control, namely the choke control for start up conditioning of the carburetor, while at the same time overcoming the problems of incomplete and/or inconsistent closure of the choke valve on the fast idle starting system of the current carburetors employing the single control feature of the '480 patent system that in turn have hitherto resulted in either poor starting or in worst cases, "no starting", conditions. Hence, the present invention also retains advantages of the '480 patent system over that of the '118 patent system, namely, lower manufacturing cost, fewer components and greater convenience to the end user.

In addition, when new fast idle lever 50 is substituted in the existing '480 control system carburetors it reliably insures that, throughout the entire range of tolerances of the system parts as made without change from present manufacturing standards, the fast idle lever 50 always will be engaged by the throttle lever 4, and the choke plate 10 will be moved to, and remain in, the fully closed position when operator manipulating forces are removed from the system and hence the same is strictly under the control of the valve return spring biasing forces in the mechanism. This is achieved at substantially no piece part cost increase over the prior system, and with a minimum of changeover cost in manufacturing production.

From the foregoing description and drawings as referenced therein, it also will now be apparent to those skilled in the art that the novel features of the improved fast idle lever 50 can also be readily adapted as a further improvement to the various forms of improved automatic fast idle latch systems as described and claimed in Swanson et al., U.S. Pat. No. 5,611,312, which is incorporated herein by reference for this purpose. Moreover, if desired, carburetors made using the dual start control system of the '118 patent fast idle latch system can also be readily converted to single control start actuation by tang push coupling together choke lever 12 and arm 24 of bell crank 20, then coupling one end of the actuator linkage to choke lever 12 and the other end to just one of the actuating members 16 or 28, the other being eliminated. Then the free end of crank arm 22 of bell crank 20 is provided with the serrated row of fine teeth 60 in the manner of fast idle lever 50.

I claim:

1. In a control mechanism for a fuel/air mixing apparatus having a throttle valve and a choke valve, said throttle valve having closed low speed idle, fast idle cold start and full speed open positions and said choke valve having cold start closed and full speed open positions, said control mechanism including first biasing means biasing said throttle valve toward its idle position, second biasing means biasing said choke valve toward its full speed position, interengageable automatic mechanical releasable latch means associated with the respective valves for releasably holding both valves in their cold start positions in opposition to the biasing means while allowing movement of said choke valve from its idle position toward its full speed position, said interengageable latch means being released by movement of the throttle valve from its cold start position toward its full speed position, said latch means comprising a choke lever and a fast idle latch lever associated with said choke valve, said choke lever having a formation for engaging a cooperative formation on said fast idle lever when said choke valve is moved from its full speed position toward its cold start position for holding said choke and fast idle lever in interengagement when so moving in opposition to the respective biasing means, and a throttle lever associated with said throttle valve for moving said throttle valve between its low speed idle position and its full speed position and latch engageable with said fast idle lever, the improvement in combination therewith wherein said latch means comprises a row of fine ratchet teeth spaced closely together on one of said fast idle and throttle levers and a pawl on the other one of said fast idle and throttle levers for selectively engaging whichever one of said ratchet teeth is aligned therewith for holding said fast idle and throttle levers in releasable one-way clutch interengagement when actuating force exerted on said control mechanism causes said choke lever to move said fast idle latch lever through a range of movement sufficient to insure said choke valve is fully moved to its design cold start closed position and said fast idle latch lever is caused to move said throttle lever sufficiently to move said throttle valve from its closed low speed idle position to its design fast idle cold start position, said row of ratchet teeth being operable with a precision clutch action by presenting sufficient pawl holding positions to insure latch lock-up that prevents or at least greatly minimizes adverse retrograde opening motion of said choke valve from its fully closed design position regardless of variations in the range of orientation of said row of fine ratchet teeth relative to said pawl throughout the range of tolerance stack-up positions of said levers as well as any remaining operably cooperative actuating parts of said control mechanism when said levers and actuating parts are mass produced to current pre-existing tolerance specifications.

2. The control mechanism of claim 1, further including control means coupled to said choke for moving said choke valve between its cold starting and full speed positions during interengagement of said interengageable means.

3. The control mechanism of claim 2 wherein said choke valve is pivotally mounted on a rotatable choke valve shaft, said fast idle lever is pivotable about said choke shaft and wherein said choke lever is non-rotatably pivotally mounted on said choke shaft, said formations on said choke and fast idle levers comprising cooperating abutment means causing said fast idle lever to pivot in unison with said choke lever when force is applied to choke lever in one direction for pivoting said choke valve from its open position into its cold starting position and bringing said fast idle and throttle levers into releasable latched interengagement, said choke lever being pivotable independently of said fast idle lever when said fast idle lever and throttle lever are interengaged in order to pivot said choke valve between its cold starting and full speed open positions, and said abutment means effecting pivoting of said fast idle lever and said choke lever in unison on release of said interengageable means to pivot said choke valve from its cold starting position to its open position.

4. The control mechanism of claim 3 wherein said second biasing means comprises a coil spring means surrounding said choke shaft and acting on said fast idle lever.

5. The control mechanism of claim 3 wherein said ratchet teeth are provided on a free end of said fast idle lever, and said pawl is provided on a free end of said throttle lever.

6. The control mechanism of claim 5 wherein said row of ratchet teeth has an overall circumferential extent at least equal in angular pivot travel to the opposite end limits of angular pivot swing tolerances of said fast idle lever when within a given angular range of pivotal positions corresponding to said choke valve reaching its fully closed cold start position.

7. In a carburetor for an internal combustion engine, in a chain saw, including throttle valve means biased toward an idle position and adapted to be displaced by a throttle actuating member from low idle to fast idle and then to full open run positions, starter choke valve means adapted to be displaced between closed start and fully open rest positions by a choke actuating member, and holding latch means which when actuated moves said throttle valve means to the fast idle start position and holds said throttle valve means in such position via latch means, said latch means being released by said throttle actuating member being actuated to move said throttle valve means from fast idle toward run position whereupon said holding latch means returns into its rest position under the action of return spring means, said holding means being operatively separate from said starter choke means and arranged to be actuated by said choke actuating member, said holding means comprising a double-arm lever having a pair of arms and being pivotal about an axis, one of said arms cooperating with said throttle actuating member to provide said holding latch means and the other of said arms being operably connected to a latch setting actuating member of said holding means, said double-arm lever being arranged to be urged against an abutment defining said rest position via said return spring means, said choke actuating member and said other arm of said double-arm lever being constructed and arranged to be adjacent to each other such that they are actuatable by a single manual choke control linkage and allowing movement of said choke actuating member independent of said double-arm lever, and wherein said latch means further comprises a row of fine ratchet teeth spaced closely together on said one arm of said double-arm lever and a pawl on said throttle actuating member selectively engaging whichever one of said ratchet teeth is aligned therewith for holding said throttle valve in the fast idle position when actuating force exerted on said choke actuating member causes said choke lever to move sufficient to insure said choke valve is fully moved to its design cold start closed position and said throttle actuating member is caused to move sufficiently to move said throttle valve from its closed low speed idle position to its design fast idle cold start position, said row of ratchet teeth being operable with a precision clutch action by presenting sufficient pawl holding positions to insure latch lock-up that prevents or at least greatly minimizes adverse retrograde opening motion of said choke valve from its fully closed design position regardless of variations in the range of orientation of said row of fine ratchet teeth relative to said pawl throughout the range of tolerance stack-up positions of said members as well as any remaining operably cooperative actuating parts of said carburetor when said member and actuating parts are mass produced to current preexisting tolerance specifications.

8. The carburetor of claim 7 wherein said row of ratchet teeth has an overall circumferential extent at least equal to the opposite end limits of angular swing tolerances of said double-arm lever when at its position corresponding to said choke valve reaching its fully closed position.

9. In a carburetor having a mixing passage, a throttle valve disposed in said mixing passage and movable between a low idle closed position and a wide open throttle position, spring means biasing said throttle valve toward the low idle position, a first control lever operable to movably displace said throttle valve between low idle and wide open positions, a choke valve movably mounted in said mixing passage, a second control lever operable to displace said choke valve between predetermined closed start and open rest positions, and cold-start holding means which when actuated by said second control lever moves said throttle valve to a predetermined cold start fast idle position via latch means, said latch means being released when said throttle valve is moved from fast idle toward open position to thereby allow said throttle valve to be controllably displaced between low idle position and wide open position against the biasing force of said spring means, the improvement in combination therewith wherein said latch means includes a row of fine ratchet teeth means and cooperative pawl means operatively coupled to said choke and throttle valves to releasably one-way stop movement of said choke and throttle valves when said valves are being moved by coupling operation of said latch means to their respective predetermined cold start positions when actuating force exerted on said second control lever causes said choke valve to be fully moved to its design cold start closed position and said cold-start holding means is caused to move said throttle valve from its closed low speed idle position to its design fast idle cold start position, said row of ratchet teeth being operable with a precision clutch action by presenting sufficient pawl holding positions to insure latch lock-up that prevents or at least greatly minimizes adverse retrograde opening motion of said choke valve from its fully closed design position regardless of variations in the range of orientation of said row of fine ratchet teeth relative to said pawl throughout the range of tolerance stack-up positions of said levers as well as any remaining operably cooperative actuating parts of said carburetor when said levers and actuating parts are mass produced to current pre-existing tolerance specifications.

10. The carburetor as set forth in claim 9 wherein said valves are pivoted to said respective valve positions and said cold start holding means comprises said second control lever and being pivotal about a rotational axis of said choke valve, said latch means being disposed on said second control lever, said first control lever being operably coupled to said throttle valve for pivotal motion therewith, said latch means also being disposed on said first control lever and cooperable with said latch means on said second control lever to perform as said cold-start holding means.

11. In a carburetor throttle and choke control mechanism incorporating a choke-throttle cold-start setting latch mechanism that automatically positions a throttle valve slightly open at a fast idle position when the choke valve is swung from open to fully closed position, and comprising a rotatable choke shaft carrying a choke plate valve, a rotatable throttle shaft carrying a throttle plate valve, a choke lever fixed on said choke shaft for rotating said choke valve from open to closed against the bias of a choke return spring, a throttle lever fixed on said throttle shaft for rotating said throttle valve from closed to open against the bias of a throttle return spring, and a fast idle latch lever journalled on said choke shaft and having a free end swingable in a travel path generally co-planar with and intersecting the travel path of a free end of said throttle lever, and releasable latch means on said free ends interengageable as a toggle held latched by said return springs in the choke-closed position of said choke valve and the fast idle position of said throttle valve, the improvement in combination therewith wherein said latch means comprises a row of fine ratchet teeth on one of said free ends and a pawl on the other of said free ends selectively engageable with whichever one of said ratchet teeth becomes aligned therewith in the toggle latching positions of said choke and throttle levers when actuating force exerted on said control mechanism causes said choke lever to move said fast idle latch lever through a range of movement sufficient to insure said choke valve is fully moved to its design cold start closed position and said fast idle latch lever is caused to move said throttle lever sufficiently to move said throttle valve from its closed low speed idle position to its design fast idle cold start position, said row of ratchet teeth being operable with a precision clutch action by presenting sufficient pawl holding positions to insure latch lock-up that prevents or at least greatly minimizes adverse retrograde opening motion of said choke valve from its fully closed design position regardless of variations in the range of orientation of said row of fine ratchet teeth relative to said pawl throughout the range of tolerance stack-up positions of said levers as well as any remaining operably cooperative actuating parts of said control mechanism when said levers and actuating parts are mass produced to current pre-existing tolerance specifications.

* * * * *